US007819640B2

(12) United States Patent
Kalavsky et al.

(10) Patent No.: US 7,819,640 B2
(45) Date of Patent: Oct. 26, 2010

(54) PUMP WITH AN INTEGRATED MOTOR

(75) Inventors: Michal Kalavsky, Kosice (SK); Pietro De Filippis, Milan (IT)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 934 days.

(21) Appl. No.: 10/565,409

(22) PCT Filed: Jul. 7, 2004

(86) PCT No.: PCT/EP2004/007446

§ 371 (c)(1),
(2), (4) Date: Mar. 21, 2006

(87) PCT Pub. No.: WO2005/015023

PCT Pub. Date: Feb. 17, 2005

(65) Prior Publication Data

US 2006/0251513 A1 Nov. 9, 2006

(30) Foreign Application Priority Data

Jul. 22, 2003 (DE) ..... 103 33 308
Nov. 7, 2003 (DE) ..... 103 52 487

(51) Int. Cl.
*F04B 35/04* (2006.01)
*F04B 17/03* (2006.01)

(52) U.S. Cl. ..... 417/369; 417/423.12

(58) Field of Classification Search ..... 417/369, 417/370, 43.12; 310/71
See application file for complete search history.

(56) References Cited

U.S. PATENT DOCUMENTS

| | | | | | |
|---|---|---|---|---|---|
| 3,288,073 | A | * | 11/1966 | Pezzillo | 417/357 |
| 3,572,982 | A | * | 3/1971 | Kozdon | 417/423.7 |
| 4,699,573 | A | * | 10/1987 | Petrie et al. | 417/370 |
| 4,762,461 | A | * | 8/1988 | Ushikoshi | 415/14 |
| 5,184,945 | A | * | 2/1993 | Chi-Wei | 417/420 |
| 5,651,380 | A | * | 7/1997 | Sargeant et al. | 134/105 |
| 5,708,313 | A | * | 1/1998 | Bowes et al. | 310/90.5 |
| 5,778,760 | A | * | 7/1998 | Yuda | 92/151 |
| 6,175,173 | B1 | | 1/2001 | Stephan et al. | |
| 6,191,506 | B1 | * | 2/2001 | Wright | 29/598 |
| 7,131,823 | B2 | * | 11/2006 | Kalavsky | 417/356 |

FOREIGN PATENT DOCUMENTS

| | | |
|---|---|---|
| DE | 38 22 897 A1 | 1/1990 |
| DE | 196 33 137 A1 | 2/1998 |
| DE | 198 42 169 A1 | 3/2000 |
| DE | 101 54 630 A1 | 5/2003 |
| FR | 2 608 228 | 6/1988 |

* cited by examiner

*Primary Examiner*—Charles G Freay
(74) *Attorney, Agent, or Firm*—Laurence A. Greenberg; Werner H. Stemer; Ralph E. Locher

(57) ABSTRACT

A pump is provided with an integrated, electronically commutated wet running engine. The pump contains a single-component pump chamber containing a rotor of the wet running engine. The pump allows the pump chamber to be continuously cleaned during the pumping process by water flowing through so that the water is not severely contaminated.

4 Claims, 2 Drawing Sheets

PUMP WITH AN INTEGRATED MOTOR

BACKGROUND OF THE INVENTION

Field of the Invention

The present invention relates to a pump with an integrated, electronically commutated wet-running motor.

In a conventionally designed pump with an integrated, electronically commutated motor, a shaft with a rotor of the motor rotates in a rotor chamber, and an impeller of the pump rotates in a hydraulic chamber. A bearing plate is located between the two chambers and has a sliding bearing for mounting the shaft, and a sealing rubber, in order to protect the sliding bearing against contamination and corrosion caused by the water. This bearing plate prevents water flowing from the hydraulic chamber to the rotor chamber. The water can enter the rotor chamber if there is a fault in the sealing rubber. Damage may be caused in the sliding bearing and in the rotor chamber on account of this contamination by the water and corrosion. The conventional design also has the disadvantage that the sliding bearing becomes worn on one side on account of the weight of the rotor.

SUMMARY OF THE INVENTION

The object of the invention is to specify a pump which has an integrated, electronically commutated wet-running motor and is protected against damage in a simple manner.

The object is achieved in that the pump has an integral pump chamber which contains a rotor of the wet-running motor. This design allows the pump chamber to be continuously cleaned during the pumping process by water flowing through, so that the water is not severely contaminated. A further advantage is that, with this design, the rotor can be cooled by water flowing through.

According to one preferred embodiment, provision is made for the pump chamber to be formed by a front housing shell and a shield of the motor. In this way, it is possible to reduce the dimensions of the pump since it is possible to dispense with a bearing plate between the rotor and an impeller of the pump.

The shield is preferably in the form of a pot. The rotor can therefore be surrounded by the shield with the smallest possible intermediate space, this resulting in a large amount of the physical volume of the motor being utilized.

According to one preferred embodiment, provision is made for the pump to have a shaft which is installed such that it cannot rotate, and on which the rotor is mounted such that it can rotate. The shaft is advantageously mounted in the shield, in particular for damping vibration in at least one O-ring which is preferably made from rubber.

In one preferred embodiment, the rotor is mounted on the shaft by means of at least one radial sliding bearing. The service life of the sliding bearing is increased in this way, since it rotates on the shaft together with the rotor.

The radial sliding bearing is preferably held in the rotor by means of an O-ring. Tolerances in the sliding bearing holder of the rotor can therefore be compensated for by the elastic O-ring, so that the sliding bearing is seated concentrically on the shaft. Furthermore, vibration of the rotor is damped by the O-ring, so that the need to damp vibration of the shaft can be reduced.

The rotor is preferably mounted on the shaft by means of an axial bearing. This has the advantage that the axial bearing reduces axial play of the rotor.

The sliding bearing and/or the axial bearing preferably have/has a liquid seal, in particular with a sealing rubber and/or an O-ring. In this way, the sliding bearing and/or the axial bearing are/is sealed during the pumping process, so that water is prevented from flowing through the sliding bearing and/or through the axial bearing, and therefore no corrosion can occur in the bearings.

According to one preferred embodiment, provision is made for the rotor to have an interior which is divided into two subregions which run toward one another in a conically tapering manner. In this way, a weak point is provided in two parts for water entering and freezing in the interior, as a result of which the tensile stresses which act on the rotor in the radial and axial directions can be reduced. The two subregions are particularly arranged between two radial sliding bearings which are held in the rotor with an elastic O-ring in each case, so that the freezing water can expand in the axial direction on account of the radial sliding bearings shifting slightly.

According to one preferred embodiment, provision is made for the rotor to have an impeller. The impeller is preferably integrally formed on the rotor. This simplifies assembly of the pump since the number of separate components is reduced.

The rotor is preferably encased in plastic. This ensures, in a simple manner, that the rotor is water-tight. Furthermore, it is therefore particularly easy to integrally form the rotor and the impeller from plastic.

Further features and advantages of the invention can be found in the following description of two exemplary embodiments with reference to the attached FIGS. 1 and 2.

DESCRIPTION OF THE PREFERRED EMBODIMENTS

Figure 1:
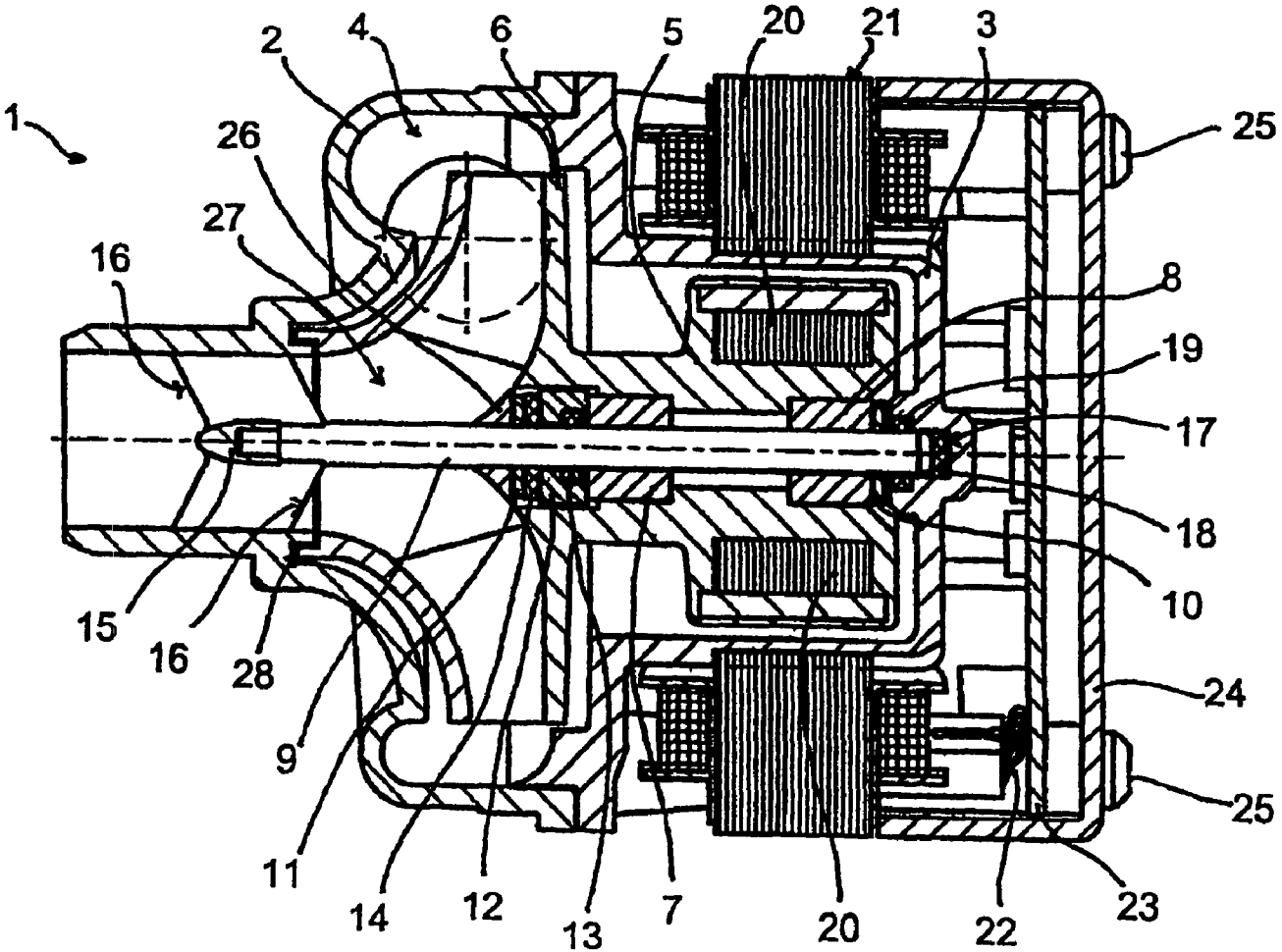
FIG. 1 shows a first embodiment.
Figure 2:
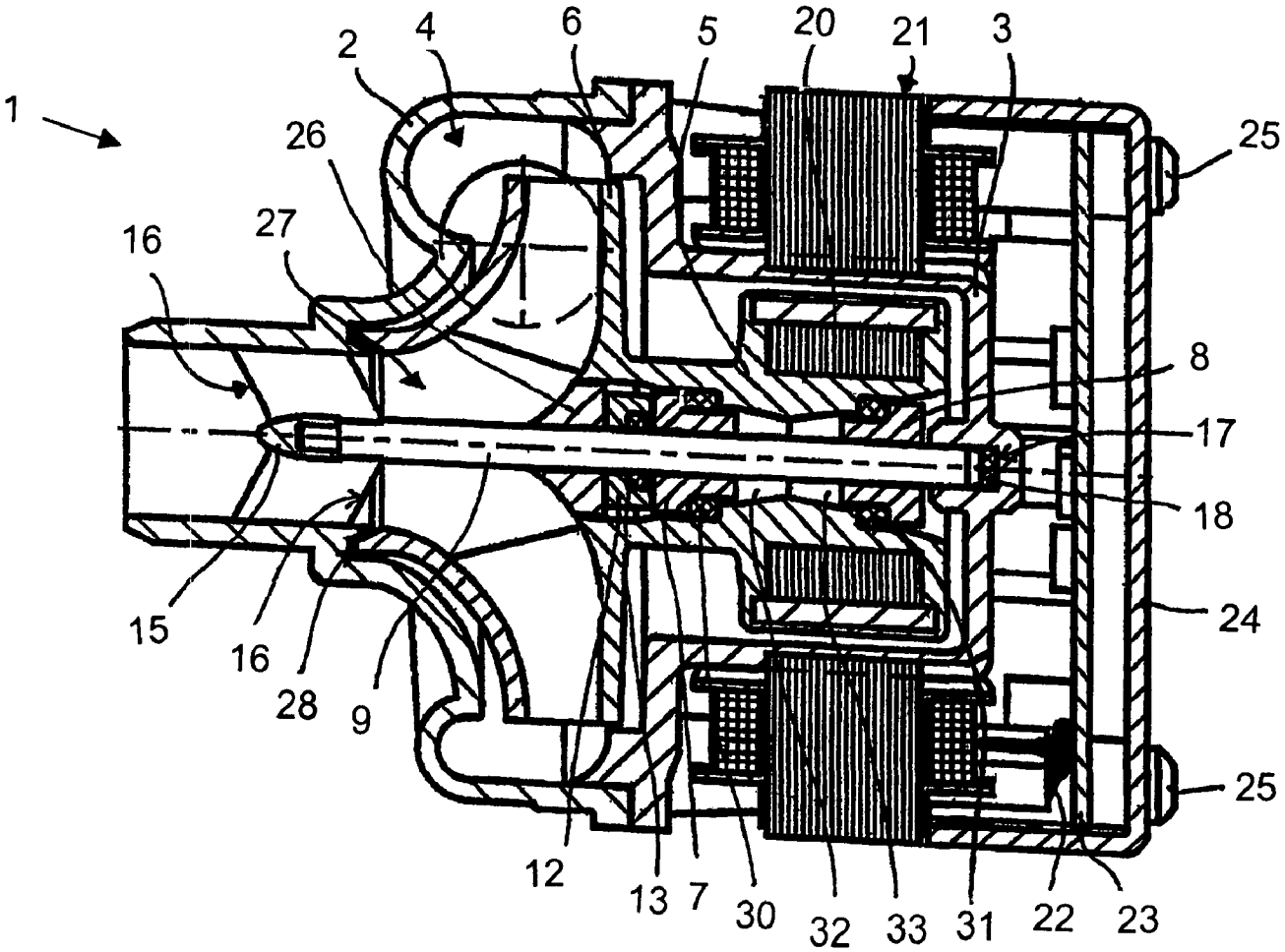
FIG. 2 shows a second embodiment of a section through the inventive pump with an integrated, electronically commutated wet-running motor.

According to FIG. 1 and FIG. 2, the housing of the pump 1 comprises a front housing shell 2 and a pot-like shield 3, which are both connected to one another in an interlocking manner. The housing of the pump 1 forms an integral pump chamber 4 whose interior contains a rotor 5 with an impeller 6. The impeller 6 is preferably integrally formed on the rotor 5.

The rotor 5 is mounted, such that it can rotate, on a shaft 9 by means of a front sliding bearing 7, which faces the impeller 6, and by means of a rear sliding bearing 8, which faces the shield 3. According to FIG. 1, in order to prevent axial movement of the rotor 5 on the shaft 9, the rotor 5 is fixed at its two ends by means of a clamping ring 10, 11 in each case. The rotor 5 also has an axial bearing 12 at its front end, which faces the impeller 6, for reducing the axial movement, with a mount for an O-ring 13 between the axial bearing 12 and the sliding bearing 7. The O-ring 13 prevents liquid, in particular water, from entering the sliding bearing 7 and elastically centers said sliding bearing in the radial direction. A rubber shock absorbing means 14 is inserted between the axial bearing 12 and the clamping ring 11.

At its front end, which faces the impeller 6, the shaft 9 is mounted, such that it cannot rotate, in a seat 15 which is fixed by carrying arms 16 on the front housing shell 2, and at its rear end, which faces the shield 3, the shaft 9 is mounted, such that it cannot rotate, in a seat 17 which is formed in the shield 3. A compensating element 18, which is preferably in the form of a rubber disk, is inserted in the seat 17 of the shield 3, in order to be able to compensate for axial changes in the length of the shaft 9 when the temperature fluctuates. In the first embodiment according to FIG. 1, the shaft 9 is fixed in the seat 17 of the shield 3 by means of an O-ring 19 in the radial direction. The O-rings 13, 19 and the compensating element 18 are particularly made from rubber, so that vibration of the rotor 5 and therefore of the shaft 9 can be absorbed.

In order to protect the permanent magnets 20 of the rotor 5 against corrosion, the entire rotor 5 is encased in plastic. The impeller 6 of the pump 1 is formed on the rotor 5 from the same plastic. The rotor 5 and the impeller 6 can therefore be integrally produced. This integral design is not absolutely necessary but has the advantage that the number of components is lower and the problem of fixing the impeller 6 on the rotor 5 is avoided.

A stator 21 of the wet-running motor is arranged outside the pot-like shield 6, and the rotor is therefore a so-called internal rotor. An embodiment in the form of an external rotor is also possible. The stator 21 is electrically connected to an electrical actuating circuit, which is arranged on a printed circuit board 23, by a spring contact 22. In this way, the pump 1 can be installed without a special soldering tool. The printed circuit board 23 is covered by a rear housing shell 24 which is connected to the stator 21 and the pot-like shield 3 by means of screws 25.

In order to improve the flow properties within the impeller 6, a shaped head piece 26 is seated on the shaft 9 as a termination piece in front of the front clamping ring 11, which faces the impeller 6, and separates the clamping ring 11 from the water-bearing region 27 of the impeller. The shape of the head piece 26 is matched to the shape of the impeller 6 in such a way that flow resistance is minimal. A gap seal 28 is formed between the impeller 6 and the front housing shell 2, and the impeller 6 rotates in said gap seal.

In the second embodiment according to FIG. 2, the radial sliding bearings 7, 8 are held in the rotor 5 by means of a respective elastic O-ring 30, 31. These O-rings 30, 31 are firstly used to compensate for tolerances in the sliding bearing holder of the rotor 5, so that the sliding bearings 30, 31 are seated concentrically on the shaft 9. Secondly, the elastic O-rings 30, 31 are used to damp vibration of the rotor 5. Therefore, in comparison to the first embodiment according to FIG. 1, it is possible to dispense with the O-ring 19 in the seat 17 of the shield 3 and the rubber shock absorbing means 14 for damping vibration of the shaft 9. Furthermore, the function of the clamping ring 11 according to FIG. 1 is already integrated in the head piece 26 in the second embodiment, so that this further component can be dispensed with too.

Between the two sliding bearings 7, 8, the internal space in the rotor 5 is divided into two subregions 32, 33 which run toward one another in a conically tapering manner. If water enters this internal space in the rotor 5 between the two sliding bearings and freezes, it splits into two parts corresponding to the subregions 32, 33. These two parts can push the radial sliding bearings 7, 8 slightly outward in the axial direction upon expansion, so that tensile stresses on the rotor 5 are reduced both in the radial and in the axial directions.

The pump 1 is designed particularly for use in domestic appliances containing water, for example dishwashers.

We claim:

1. A pump, comprising:

an integrated, electronically commutated wet-running motor (5, 21) having a rotor (5);

an integral pump chamber (4) containing said rotor (5) of said wet-running motor;

a shaft (9) installed such that said shaft cannot rotate, and said rotor (5) being mounted on said shaft such that said rotor can rotate;

a shield (3); and at least one O-ring (19) fixing said shaft in said shield.

2. A pump, comprising:

an integrated, electronically commutated wet-running motor (5, 21) having a rotor (5);

an integral pump chamber (4) containing said rotor (5) of said wet-running motor;

a shaft (9) installed such that said shaft cannot rotate, and said rotor (5) being mounted on said shaft such that said rotor can rotate; and an axial bearing (12), said rotor (5) mounted on said shaft (9) by said axial bearing (12), and said axial bearing (12) having a liquid seal;

wherein said liquid seal has a rubber shock absorbing device (14).

3. A pump, comprising:

an integrated, electronically commutated wet-running motor (5, 21) having a rotor (5);

an integral pump chamber (4) containing said rotor (5) of said wet-running motor;

a shaft (9) installed such that said shaft cannot rotate, and said rotor (5) being mounted on said shaft such that said rotor can rotate; and an axial bearing (12), said rotor (5) mounted on said shaft (9) by said axial bearing (12), and said axial bearing (12) having a liquid seal;

wherein said liquid seal has an O-ring (13).

4. A pump, comprising:

an integrated, electronically commutated wet-running motor (5, 21) having a rotor (5);

an integral pump chamber (4) containing said rotor (5) of said wet-running motor; and a shaft (9) installed such that said shaft cannot rotate, and said rotor (5) being mounted on said shaft such that said rotor can rotate;

wherein said rotor (5) has an internal space formed therein being divided into two subregions (32, 33) which run toward one another in a conically tapering manner.

* * * * *